United States Patent [19]

Lofredo

[11] Patent Number: 4,689,962

[45] Date of Patent: Sep. 1, 1987

[54] PROCESS AND APPARATUS FOR HANDLING A VAPORIZED GASEOUS STREAM OF A CRYOGENIC LIQUID

[75] Inventor: Antony Lofredo, Springfield, N.J.

[73] Assignee: The Boc Group, Inc., Montvale, N.J.

[21] Appl. No.: 819,560

[22] Filed: Jan. 17, 1986

[51] Int. Cl.[4] ..... F17C 13/00

[52] U.S. Cl. ..... 62/54; 220/85 VR

[58] Field of Search ..... 62/54; 220/85 VR, 85 VS; 55/88, 89

[56] References Cited

U.S. PATENT DOCUMENTS 3,034,308 5/1962 Littlewood ..... 62/54

3,112,617 12/1963 Hashemi-Tafreshi ..... 62/54

3,714,790 2/1973 Battey ..... 62/54

3,800,550 4/1974 Delahunty ..... 62/54

3,914,949 10/1975 Maher et al. ..... 62/54

*Primary Examiner*—Ronald C. Capossela

*Attorney, Agent, or Firm*—Larry R. Cassett; Chris P. Konkol

[57] ABSTRACT

There is disclosed a process and apparatus for passing the uncondensed and/or vaporized gaseous stream generated from a cryogenic liquid in heat transfer relationship with a compressed gaseous stream thereof thereby to heat the uncondensed and/or vaporized gaseous stream prior to compression thereof to form a portion of said compressed gaseous stream.

8 Claims, 1 Drawing Figure

PROCESS AND APPARATUS FOR HANDLING A VAPORIZED GASEOUS STREAM OF A CRYOGENIC LIQUID

FIELD OF THE INVENTION

This invention relates to a process for handling cryogenic liquids, and more particularly to an improved process for handling a vaporized gaseous stream of a cryogenic liquid, and/or uncondensed gases in the production thereof.

BACKGROUND OF THE INVENTION

The production of permanent gases. such as argon, nitrogen and oxygen from air using cryogenic techniques has expanded almost exponentially over the years. The production of such gases using cryogenic techniques requires the expenditure of considerable amounts of energy given the operational low temperature levels and given the cost of energy required to produce and store the respective permanent gases.

In the storage of liquefied permanent gases or cryogenic liquids, there is a considerable amount of "boil-off" notwithstanding the current state of the art of heat transfer materials for the storage thereof. In the handling and transportion of such cryogenic liquids from the storage tank to tanker cars and to trailers for shipment to users, there is also significant boil-off, again notwithstanding the sophistication of heat transfer materials and equipment. Generally, the vapors resulting from any such boil-off have either been vented to the atmosphere or repressurized in expensive low temperature compressors which are readily subject to frequency failure as a result of low temperature duty. Given the cost of producing such liquefied permanent gases the venting and/or low temperature compression results in an unacceptable economic energy loss considering the constantly increasing growth of the industry.

OBJECTS OF THE INVENTION

An object of the present invention is to provide an improved process for recovering uncondensed and/or vaporized gaseous streams from the handling and storage of permanent gases.

Another object of the present invention is to provide an improved process for recovering uncondensed and/or vaporized gaseous streams from the handling and storage of permanent gases in an efficacious manner.

Still another object of the present invention is to provide an improved process for recovering uncondensed and/or vaporized gaseous streams from the handling and storage of permanent utilizing inexpensive equipment.

Yet another object of the present invention is to provide an improved process for recovering uncondensed and/or vaporized gaseous streams from the handling and storage of permanent gases utilizing inexpensive equipment not given to frequency breakdown.

A further object of the present invention is to provide an improved process for recovering uncondensed and/or vaporized nitrogen resulting from the storage and handling of liquefied nitrogen.

SUMMARY OF THE INVENTION

These and other objects of the present invention are achieved by passing the uncondensed and/or vaporized gaseous stream generated from a cryogenic liquid in heat transfer relationship with a compressed gaseous stream thereof thereby to heat the uncondensed and/or vaporized gaseous stream prior to compression thereof to form a portion of said compressed gaseous stream.

BRIEF DESCRIPTION OF THE DRAWING

A better understanding of the present invention will become apparent upon consideration of the detailed disclosure thereof, especially when taken with the accompanying drawing illustrating a schematic flow diagram of the process of the present invention. To facilitate an understanding of the present invention, it will be understood that additional valving and piping configurations are provided consistent with accepted practices in the art.

DETAILED DESCRIPTION OF THE INVENTION

Figure 1:
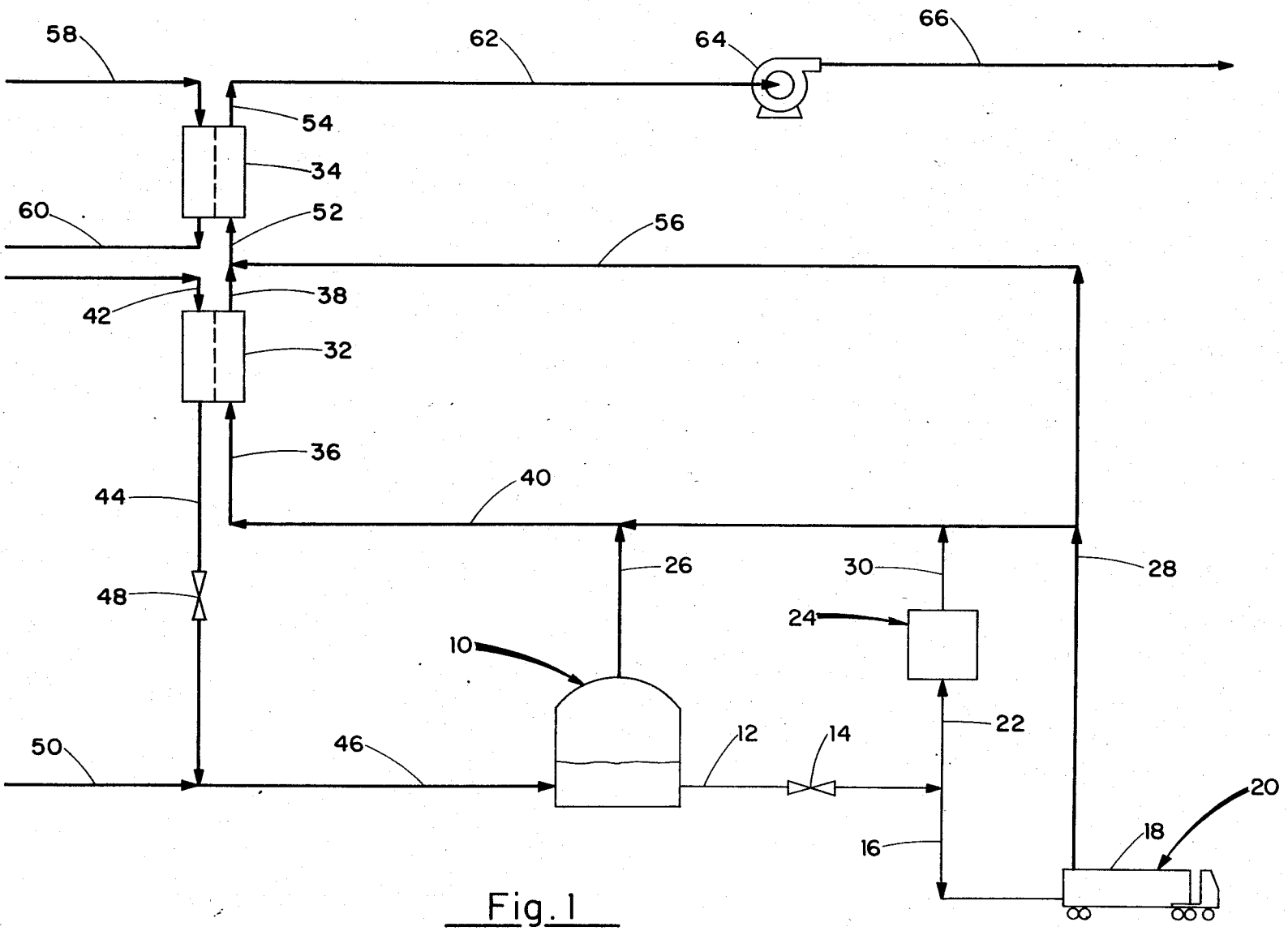

Referring now to the drawing, there is illustrated a storage tank, generally indicated as 10, for the storage of a cryogenic liquid, e.g. liquefied nitrogen, generally at slightly above about atmospheric pressure and at a temperature of about −320° F. to −300° F. The storage tank 10 is provided with a conduit 12 under the control of valve 14 for withdrawing cryogenic liquid therefrom for passage via conduit 16 to a transportation trailer 18 of a tractor-trailer set, generally indicated as 20, or for passage via conduit 22 to user equipment, generally indicated as 24. Such user equipment 24 including heat transfer equipment associated with storage tanks, etc. in the storage and handling of permanent gases, e.g. liquefied argon or liquefied oxygen having boiling parts higher than the boiling point of nitrogen.

The storage tank 10 is provided with a conduit 26 for withdrawing "boil-off" vapors as well as uncondensed vapor resulting from the production of the cryogenic lqiuid by expansion of compressed vapors thereof. The tractor-trailer set 20 is provided with a conduit 28 for withdrawing vapors generated during the filling of trailer 18 with cryogenic liquid. User equipment 24 is provided with a conduit 30 for withdrawing vapors therefrom used to maintain cryogenic liquids having a boiling point higher than the boiling point of cryogenic liquid in storage tank 10.

The process of the present invention includes heat transfer assemblies 32 and 34 for passing fluids in indirect heat transfer relationship therethrough as more fully hereinafter described. Heat transfer assembly 32 is provided with an inlet conduit 36 and an outlet conduit 38 for the passage of one fluid therethrough with the inlet conduit being in fluid flow communication by conduit 40 with lines 26, 28 and 30. The heat transfer assembly 32 is provided with the inlet conduit 42 and outlet conduit 44 for the passage of another fluid therethrough. The outlet conduit 44 includes an expansion valve 48 in fluid flow communication by conduit 46 with storage tank 10. A conduit 50 is provided in fluid flow communication with conduit 46 as more fully hereinafter described.

Heat transfer assembly 34 is provided with an inlet conduit 52 and an outlet conduit 54 for the passage of one fluid therethrough with the inlet conduit 52 being in fluid flow communication with outlet conduit 38 and with conduit 56 with lines 28 and 30. The heat transfer assembly 34 is provided with the inlet conduit 58 and outlet conduit 60 for the passage of another fluid therethrough. The outlet conduit 54 is in fluid flow communication by conduit 62 with the suction side of a pump 64 having a discharge conduit 66.

To facilitate an understanding of the process of the present invention, the process of the present invention will be described with reference to the storage and handling of liquefied nitrogen, it being understood from the present invention that other cryogenic liquids may be stored and handled in accordance therewith. Vapors at a temperature above the boiling point of nitrogen in lines 26, 28 and/or 30 are passed via line 40 and introduced into heat transfer assembly 32 by line 36 for passage in indirect heat transfer relationship with a fluid in line 42. The fluid in line 42 is a compressed gaseous stream of nitrogen at elevated temperatures wherein the compressed gaseous stream is cooled to a temperature whereby subsequent expansion through valve 48 effects liquefaction of a substantial portion of such compressed gaseous stream withdrawn from the heat transfer assembly 32 via lines 44 and passed via line 46. It is understood that the flow of a compressed gaseous stream in line 42 is controlled in response to the flow of vapors in line 36 to recover the cold potential therein.

A cold potential may still exist in the vapor stream withdrawn from heat transfer assembly 32 in line 38 and is thus passed via line 52 through heat transfer assembly 34 for indirect heat transfer relationship with another fluid in line 58, e.g. a refrigerant such as freon, and withdrawn by line 60 from heat transfer assembly 34 for use in other processing units of the liquefaction plant processing the permanent gases. The thus further heated vapors in line 54 withdrawn from heat transfer assembly 34 at a temperature at which compression to elevated pressures may be readily effected in conventional equipment is passed by pump 64 from line 62 to line 66 for further processing (not shown) to form a portion of the process stream in lines 42 and/or 50. Generally, the major portion of the compressed gaseous stream passed to the storage tank 10 is passed by line 50 to line 46, the amount of the compressed gaseous stream on line 42 being a function of the flow of vaporized or uncondensed gas in lines 26, 28 and 30.

Thus, in accordance with the process of the present invention, the cold potential of the vapors withdrawn from diverse sources in the handling and storage of a liquefied nitrogen is effectively recovered in a manner to provide a recoverable gaseous stream at elevated temperatures which may be effectively compressed to a desired pressure level using conventional pressurizing equipment.

While the present invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. A process for gas treating comprising the steps of:

(a) recovering boil-off vapors generated in the storage and/or handling of a cryogenic liquid;

(b) passing said boil-off vapors in indirect heat transfer relationship with a compressed gaseous stream to be expanded to form said cryogenic liquid to thereby cool said compressed gaseous stream and thereby heat said boil-off vapors;

(c) expanding said thus cooled compressed gaseous stream of step (b) to form cryogenic liquid;

(d) compressing said thus heated boil-off vapors of step (b); and (e) admixing said compressed boiled-off vapors of step (d) with said compressed gaseous stream of step (b) prior to step (c).

2. The process as defined in claim 1 wherein said boil-off vapors are generated in the storage of said cryogenic liquid.

3. The process as defined in claim 1 wherein said boil-off vapors are generated in handling of said cryogenic liquid for shipment of said cryogenic liquid to a remote location.

4. The process as defined in claim 1 wherein said boil-off vapors are generated in use of said cryogenic liquid as a refrigerant.

5. The process as defined in claim 1 wherein said boil-off vapors are passed in further heat transfer relationship to further heat said boil-off vapors prior to step (d).

6. The process as defined in claim 1 wherein said boil-off vapors are generated in the storage of said cryogenic liquid and wherein said cryogenic liquid produced during expansion of said compressed gaseous stream is returned to storage.

7. The process as defined in claim 1 wherein said cryogenic liquid is nitrogen.

8. The process as defined in claim 1 wherein flow of said compressed gaseous stream is controlled in response to flow of said boil-off vapors.

* * * * *